US005177547A

United States Patent [19]

Kanemitsu et al.

[11] Patent Number: 5,177,547

[45] Date of Patent: Jan. 5, 1993

[54] RECORDING APPARATUS WHICH USES THE SHEET EJECTION OUTLET AS A SHEET INSERTION INLET

[75] Inventors: Shinji Kanemitsu; Yasuo Miyauchi, both of Yokohama; Tokihide Ebata, Kawasaki; Akihiro Nomura, Yokohama; Akio Takeda, Kawasaki; Haruo Uchida, Yokohama; Mitsuru Kurata, Kawasaki; Shigeyoshi Onoda, Yokohama, all of Japan

[73] Assignee: Canon Kabushiki Kaisha, Tokyo, Japan

[21] Appl. No.: 865,633

[22] Filed: Apr. 9, 1992

Related U.S. Application Data

[63] Continuation-in-part of Ser. No. 731,396, Jul. 17, 1991, abandoned, which is a continuation of Ser. No. 514,714, Apr. 26, 1990, abandoned.

[30] Foreign Application Priority Data

Apr. 26, 1989 [JP] Japan ..... 1-104668
Feb. 14, 1990 [JP] Japan ..... 2-34456

[51] Int. Cl.[5] ..... G03G 21/00

[52] U.S. Cl. ..... 355/321; 271/9; 271/902; 355/308

[58] Field of Search ..... 271/9, 902; 355/308, 355/309, 317, 321; 346/76 PH

[56] References Cited

U.S. PATENT DOCUMENTS 4,279,504 7/1981 Brown et al. ..... 355/309 X
4,395,118 7/1983 Komori et al. ..... 355/309 X
4,404,568 9/1983 Kikuchi et al. ..... 346/76 PH
4,417,350 11/1983 Ito et al. ..... 355/309 X
4,436,406 3/1984 Murasaki et al. ..... 355/309
4,437,656 3/1984 Onoda et al. ..... 271/10
4,463,359 7/1984 Ayata et al. ..... 346/1.1
4,540,268 9/1985 Toyono et al. ..... 355/210
4,619,388 10/1986 Ono et al. ..... 226/76
4,657,375 4/1987 Watanabe et al. ..... 355/308
4,699,366 10/1987 Kashimura et al. ..... 271/4

FOREIGN PATENT DOCUMENTS 3723391 3/1988 Fed. Rep. of Germany .
59-59482 4/1984 Japan .
0245777 11/1986 Japan .
0164391 7/1987 Japan .

OTHER PUBLICATIONS

European Search Report. .

*Primary Examiner*—A. T. Grimley
*Assistant Examiner*—William J. Royer
*Attorney, Agent, or Firm*—Fitzpatrick, Cella, Harper & Scinto

[57] ABSTRACT

The present invention provides a recording apparatus with a supply roller for supplying a sheet, a sheet directing path for directing the sheet supplied by the supply roller to a recording portion, a sheet ejection path for directing the sheet recorded at the recording portion to an ejection outlet, a guide for guiding a sheet to be introduced from the ejection outlet, and sheet feeding rollers and detectors for directing the introduced sheet to the recording portion through the sheet ejection path and thereafter for returning the sheet to the ejection outlet.

29 Claims, 20 Drawing Sheets

RECORDING APPARATUS WHICH USES THE SHEET EJECTION OUTLET AS A SHEET INSERTION INLET

This application is a continuation of application Ser. No. 07/731,396 filed Jul. 17, 1991, now abandoned, which is a continuation of application Ser. No. 07/514,714, filed Apr. 26, 1990, now abandoned.

BACKGROUND OF THE INVENTION

1. Field of the Invention

The present invention relates to a recording apparatus, and more particularly, it relates to a recording apparatus such as a copying machine, printer and the like, in which one of, for example, at least two sheet feeding systems can be selected.

2. Related Background Art

An example of conventional recording apparatus having two or more sheet feeding systems is shown in FIG. 1.

In FIG. 1, sheets 3 stacked in a cassette 2 are fed toward feed rollers 6 arranged in sheet guides 5 by means of a sheet supply roller 1 which constitutes a first sheet supply means. Meanwhile, the sheets are separated one by one by means of a separating claw 4. By means of the feed rollers 6, the sheet is further fed to auxiliary scanning rollers 7, by which the sheet is fed to a printing portion 8 by one printing width. A printing head 9 is shifted in a transverse direction along guide rails 19*a* and 19*b* and can record an image on the sheet at the printing portion 8 by injecting ink droplets onto the sheet. The sheet on which the image has been recorded is then ejected from an ejection outlet 11 onto an ejector tray 12 by means of ejector rollers 10.

On the other hand, a second sheet supply means is used for performing a so-called manual sheet supply wherein a single sheet is set on a manual sheet supply tray 13 and is inserted from a sheet supply inlet 14, and the sheet is then fed to the auxiliary scanning rollers 7 through guide plates 14 by means of manual sheet supply rollers 15. The sheet outcoming from the auxiliary scanning rollers 7 is printed in the same manner as the printing process effected on the sheet fed from the cassette 2, and thereafter, the sheet is ejected from the ejection outlet 11 onto the ejector tray 12 by means of the ejector rollers 10.

Further, the afore-mentioned cassette 2 can be withdrawn in a direction shown by the arrow A in FIG. 1 for replenishing the sheets 3.

In the above conventional recording apparatus, as shown in FIG. 1, the insertion and withdrawal of the cassette 2 and/or the treatment of the printed sheets are performed at the left side of the recording apparatus, whereas the manual sheet supply is performed at the right side of the recording apparatus. Accordingly, the conventional recording apparatus requires not only the space for installing the apparatus itself, but also the spaces, at the left and right sides of the apparatus, for performing the treatment of the cassette and of the printed sheets and the manual sheet supply, which results in a drawback that a large total space is required for manipulating the recording apparatus.

Further, in such a recording apparatus, it is practical that an operating portion or station for handling the apparatus is positioned at a front side which is usually the left side of the apparatus to which the printed sheets are ejected. However, when the recording apparatus is used in a condition such that the whole apparatus is installed on a shelf and the like, the manual sheet supply tray 13 and the manual sheet supply inlet 14 are obstructed by the shelf wall, thus making the use of the manual sheet supply impossible.

SUMMARY OF THE INVENTION

In order to eliminate the above-mentioned conventional drawbacks, the present invention provides a recording apparatus wherein an ejection outlet for sheets fed from a main sheet supply means is available as an insertion inlet for sheets treated by a secondary or auxiliary sheet supply means, and the insertion inlet is again used as an ejection outlet for the printed sheets fed from the auxiliary sheet supply means, thereby the insertion and ejection of all the sheets can be effected at only one side of the recording apparatus.

Since the sheet supply means of the recording apparatus according to the present invention is constructed as mentioned above, only one opening can be used both as the sheet ejection outlet and the sheet insertion inlet, thus making the apparatus small-sized. Further, since the ejection outlet and the insertion inlet are positioned at the same side of the recording apparatus, the operability of the apparatus can be considerably improved.

In addition, by providing a sheet hold-down member which can be abutted against and separated from the (recording) sheet, it is possible to prevent floating of the sheet during recording by abutting the sheet hold-down member against the sheet and to prevent the bad influence upon the feeding accuracy of the sheet during the sheet feeding by separating the sheet hold-down member from the sheet.

Furthermore, by performing the abutment and separation of the sheet hold-down member in response to the scanning operation of recording means, the sheet hold-down member can be abutted against the sheet during recording and can be separated from the sheet during sheet feeding with a simple construction.

DESCRIPTION OF THE PREFERRED EMBODIMENTS

Figure 1:
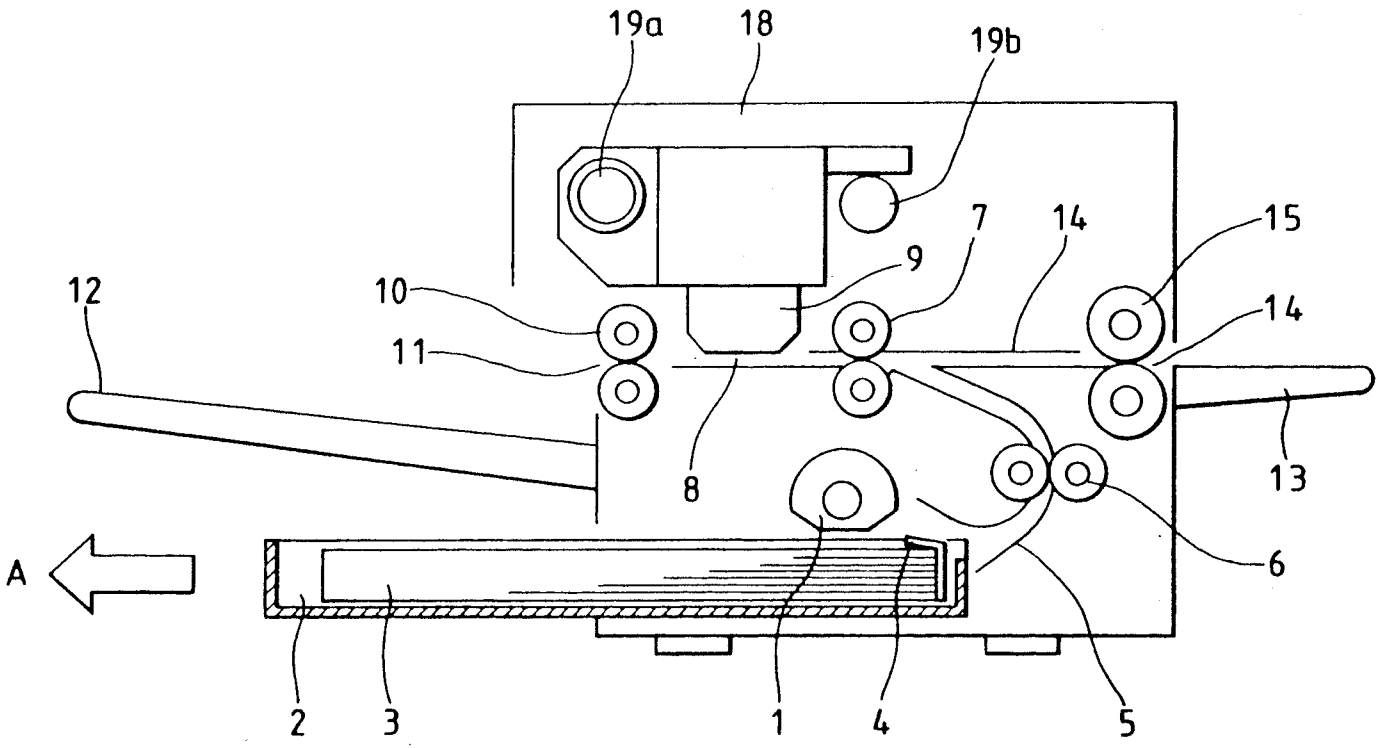
FIG. 1 PRIOR ART
FIG. 1 is a schematic sectional elevational view of a conventional recording apparatus.
Figure 2:
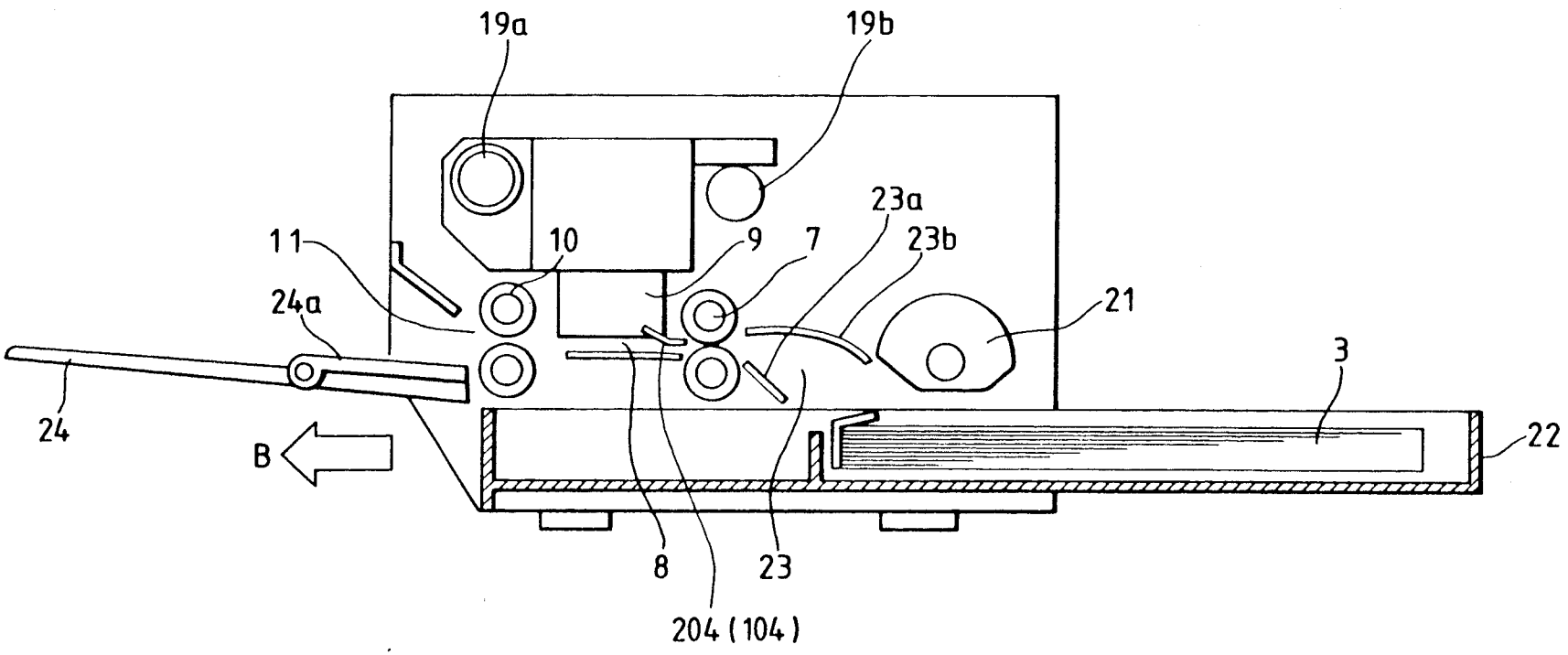
FIG. 2 is a schematic sectional elevational view of a recording apparatus according to a preferred embodiment of the present invention, showing a condition wherein a sheet is fed from an inserted cassette.

FIG. 2 shows a sectional view of a recording apparatus according to a preferred embodiment of the present invention. In FIG. 2, a left side of the apparatus is a front side of the recording apparatus.

FIG. 2 further shows a condition wherein the sheet is fed from a cassette 22 acting as a first sheet supply means. A feeding and guiding portion 23 for the sheet comprises sheet guides 23*a* and 23*b* and serves to direct the sheet 3 picked up from the cassette 22 by a supply roller 21 to auxiliary scanning rollers 7. In a printing portion or station 8, an image is printed or recorded on the sheet by injecting ink droplets onto the sheet from a printing head 9 shiftable in a transverse direction along guide rails 19*a* and 19*b*.

The ink cartridge (printing head) 9 is constituted by a head 9*a* and an ink tank which are integrally formed, and can be changed in a disposable or non-returnable manner. The head 9*a* is provided with a plurality of liquid passages (not shown) filled with liquid (ink). In a steady state, the ink filling the liquid passages is balanced at outlets of orifices by surface tension and external pressure.

Electrical/thermal converters are arranged in the respective liquid passages. By applying at least one driving signal causing the abrupt increase of temperature beyond the nucleate boiling to the respective electrical/thermal converter, thermal energy is generated, thereby, evaporating the adjacent ink to cause the film boiling thereof. In this way, the bubbles are generated in the ink in response to the driving signal, and the ink is discharged from the outlet of the orifice toward the recording sheet 3 by the growth of the bubbles. Further, the bubbles are cooled by the ink and disappear, and the ink is gradually supplied to the liquid passages from the ink tank by the capillary phenomenon.

As mentioned above, by inducing and eliminating the bubbles in the liquid passage filling the ink, it is possible to discharge the ink from the outlet of the orifice to create one ink droplet. Accordingly, when the driving signal is applied to the corresponding electrical/thermal converter as a pulse in accordance with image information, the growth and disappearance of the bubbles are instantaneously effected, thereby discharging the ink droplet from the outlet of the orifice of the head 9*a* toward the recording sheet 3 to record an image on the sheet.

The recorded or printed sheet is ejected from an ejection outlet 11 onto an ejector tray 24 by means of ejector rollers 10. The cassette 22 can be withdrawn in a direction shown by the arrow B for replenishing the sheets.

Figure 3:
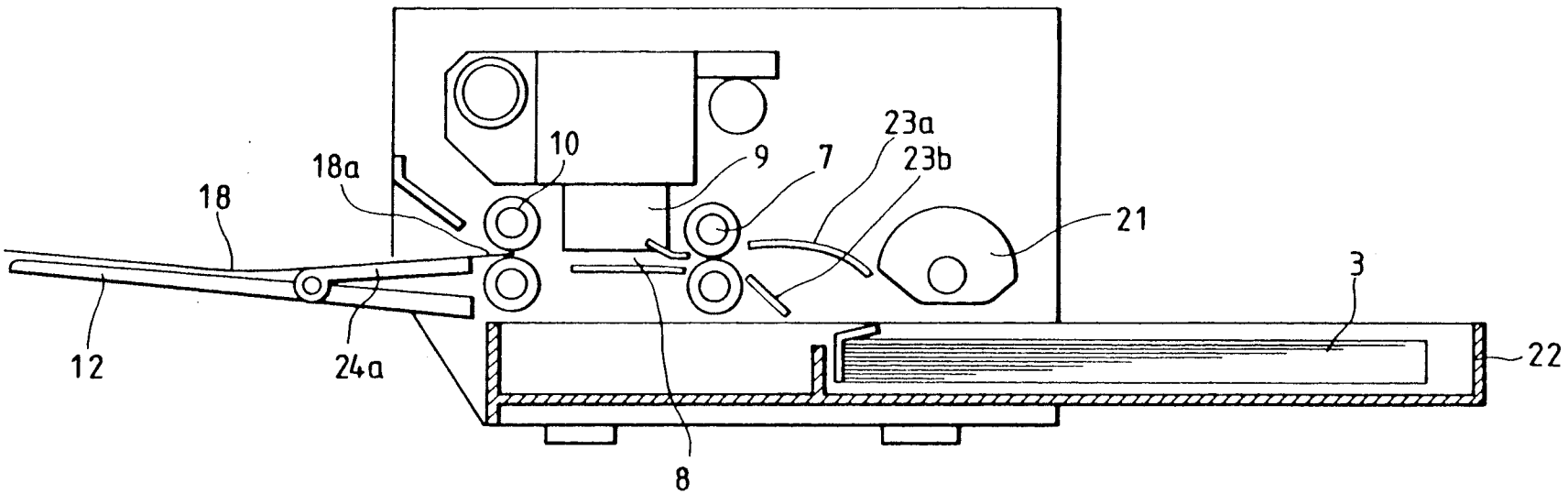
FIG. 3 is a schematic sectional elevational view similar to FIG. 2, but showing a condition wherein a manual sheet supply is performed.
Figure 4:
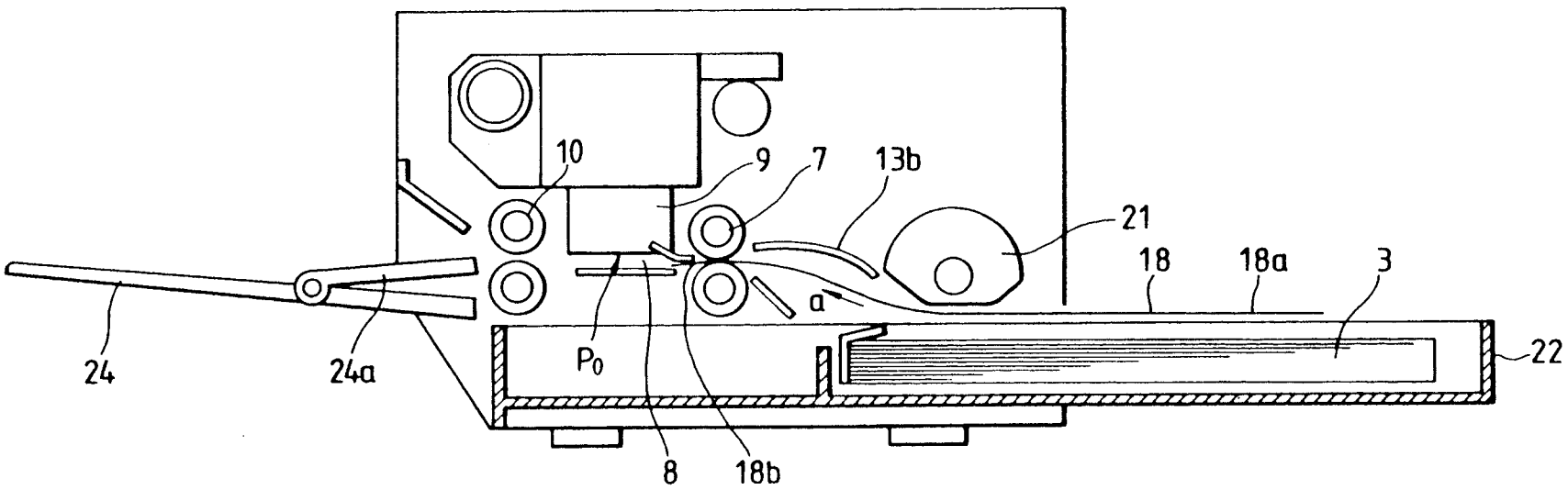
FIG. 4 is a schematic sectional elevational view of the recording apparatus, showing a condition wherein a sheet has been inserted into the apparatus during the manual sheet supply.
Figure 5:
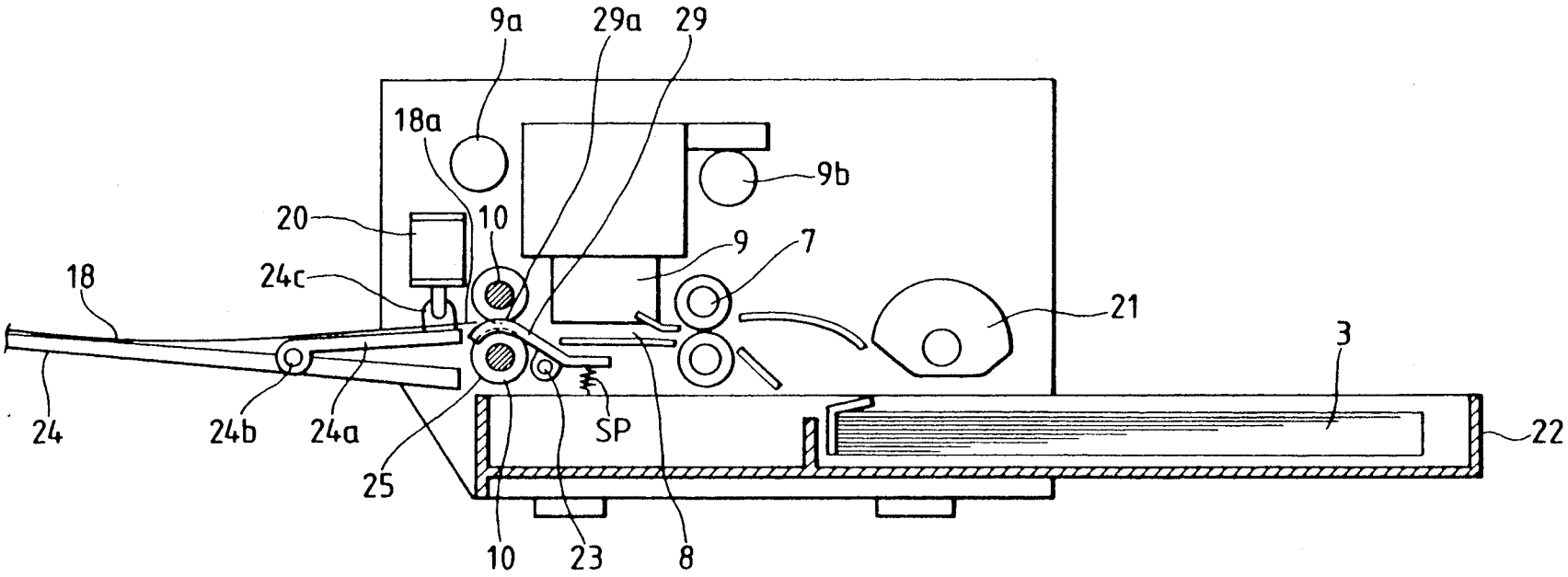
FIG. 5 is a schematic sectional elevational view showing the details of a sheet supply portion.

FIGS. 3 and 4 show a condition wherein a manual sheet supply is performed, and FIG. 5 shows the details of the manual sheet supply.

In FIG. 5, a manual sheet supply guide plate 24*a* is pivotably mounted by a hinge 24*b* on the ejector tray 24. A free end of the guide plate 24 has a hinge bracket 24*c* which is positioned outside a sheet feeding path and is connected to a plunger 20. By energizing the plunger 20, the free end of the manual sheet supply guide plate 24*a* is lifted in alignment with a nip between the ejector rollers 10 as shown in FIG. 5; whereas, when the plunger is deenergized, the guide plate 24*a* is returned to a position shown in FIG. 2 by its own weight.

A lever 29 for detecting the presence of the sheet has an arcuate end portion 29*a* and is pivotably mounted on a hinge 23 in such a manner that it can be rocked toward a stepped portion 25 provided in the ejector roller 10 in the sheet path and can be maintained stationary so that the arcuate end portion 29*a* is positioned above the nip between the ejector rollers 10 (by the balance between the weight of the lever and a force of a spring SP). Accordingly, even if the sheet is fed from either the left or the right, when the sheet is nipped by the ejector rollers 10, the lever 29 is rocked downwardly, thus interrupting a photo-sensor (not shown) to generate a signal representative of the presence of the sheet.

Figure 9:
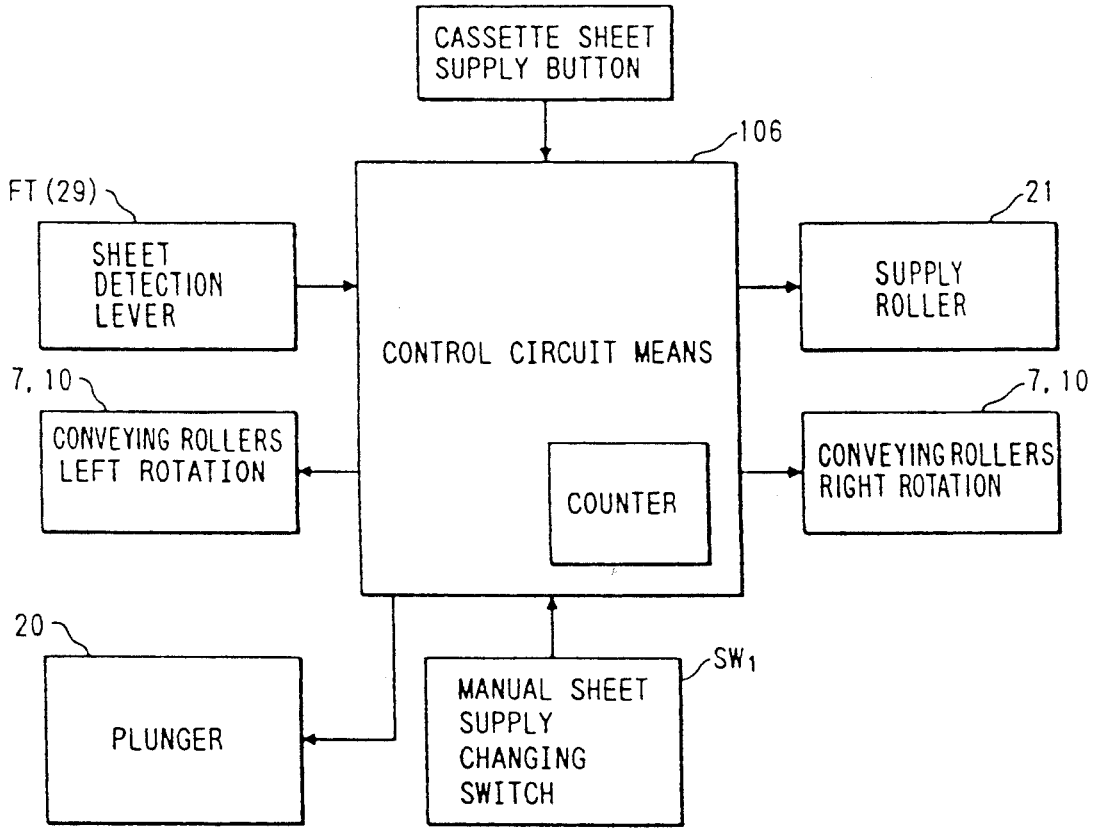
FIG. 9 is a control block diagram for the recording apparatus of FIG. 2.
Figure 10:
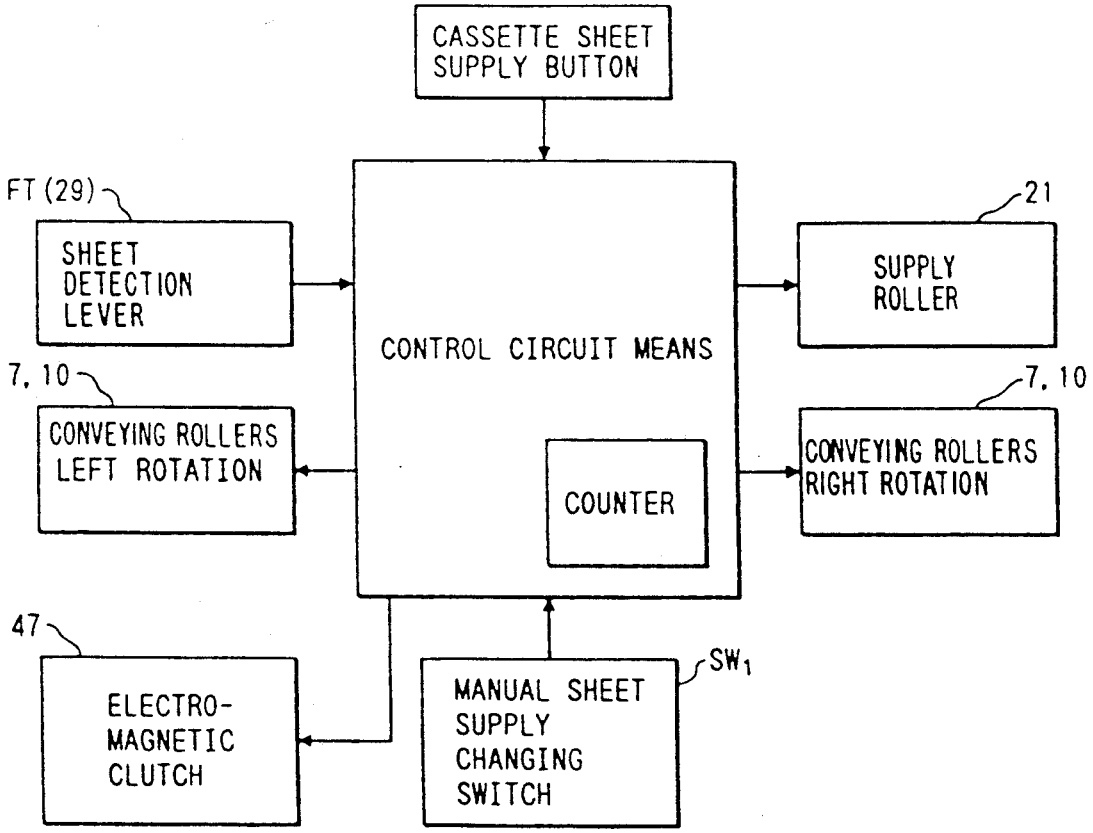
FIG. 10 is a block diagram for the recording apparatus of FIG. 7.
Figure 11:
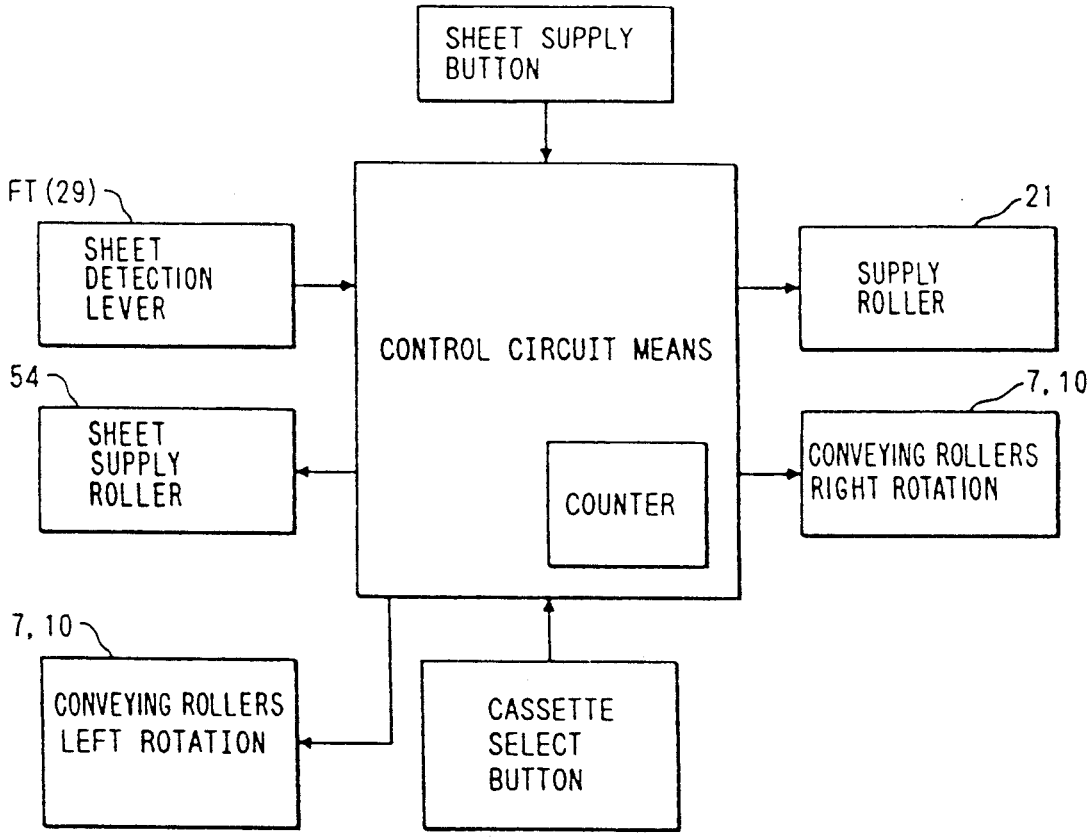
FIG. 11 is a control block diagram for the recording apparatus of FIG. 8.

FIG. 3 shows a condition wherein a sheet 18 is set for the manual sheet supply. By depressing a manual sheet supply changing switch SW1 (FIG. 9), an electric system is changed from a cassette sheet supply mode to a manual sheet supply mode, and at the same time, the plunger 20 is energized, thereby lifting the guide plate 24*a* in the position mentioned above. Thereafter, when an operator inserts the sheet along the guide plate 24*a*, the leading end 18*a* of the sheet is abutted against the nip between the ejector rollers 10 and urges the sheet detection lever 29. When the lever 29 is urged, the photo-sensor (FT) generates an electrical signal to rotate the ejector rollers 10 and the auxiliary scanning rollers 7 in a reverse direction opposite to the normal rotating direction, respectively, thus introducing a manually inserted sheet into the apparatus. The leading end 18*a* of the introduced sheet is directed, by guide plates 23*a*, and 23*b*, to a space between the supply roller 21 and an uppermost sheet in the sheet stack positioned in the cassette 22.

FIG. 4 shows a condition wherein the manually inserted sheet 18 is temporarily stopped after the trailing end 18*b* of the sheet has passed beyond the detection lever 29 and passed through the printing portion 8 and has been nipped between the auxiliary scanning rollers 7. More particularly, when the trailing end of the sheet has just passed through the detection lever 29 the count is started, and, when a predetermined count is reached the reverse rotation of the auxiliary scanning rollers is stopped. From the condition shown in FIG. 4, in response to a sheet feed start signal (i.e., print start signal), when the auxiliary scanning rollers 7 and the ejector rollers 10 are rotated in the normal direction and at the same time, the plunger 20 is deenergized, the manually inserted sheet is returned to the condition shown in FIG. 3; Meanwhile, the sheet 18 is subjected to the printing operation and then is ejected in the same manner as that performed with respect to the sheet fed from the cassette 22.

If a further manual sheet supply is desired, the ejected sheet 18 is removed and a new sheet is positioned on the tray 24 and then the manual sheet supply changing switch is depressed again. On the other hand, if it is desired to feed a sheet from the cassette after the manually inserted sheet has been ejected, the normal printing operation may be performed.

With the arrangement as mentioned above, when an operation or console panel is arranged at the side of the ejection outlet of the recording apparatus, since the sheet supply from the cassette, withdrawal of the cassette, manual sheet supply and the ejection of the sheet can be all performed at the same side of the apparatus (left side of the apparatus in FIG. 2), the recording apparatus can be used in a manner so that the apparatus can be installed on a shelf or the like.

Further, since the ejector rollers and the auxiliary scanning rollers can be used as feeding rollers for feeding the manually inserted sheet by rotating these rollers in the reverse direction, there is no need to provide additional sheet feeding means (such as supply roller and feeding rollers) which are exclusive for the manual sheet supply, and the number of guide plates can be minimized, thereby making the whole apparatus small-sized and inexpensive.

Incidentally, in the condition shown in FIG. 4, the manually inserted sheet may be stopped in such a manner that the trailing end 18*b* of the sheet is positioned below a printing position $P_o$ (in this case, the image can be printed on the sheet immediately) or may be stopped immediately after the trailing end of the sheet has just passed through the nip between the ejector rollers 10 (in this case, the sheet is tensioned at the start of the printing operation). The positioning of the sheet is effected by counting the pulses after the trailing end of the sheet has just passed through the ejector rollers 10.

Figure 6:
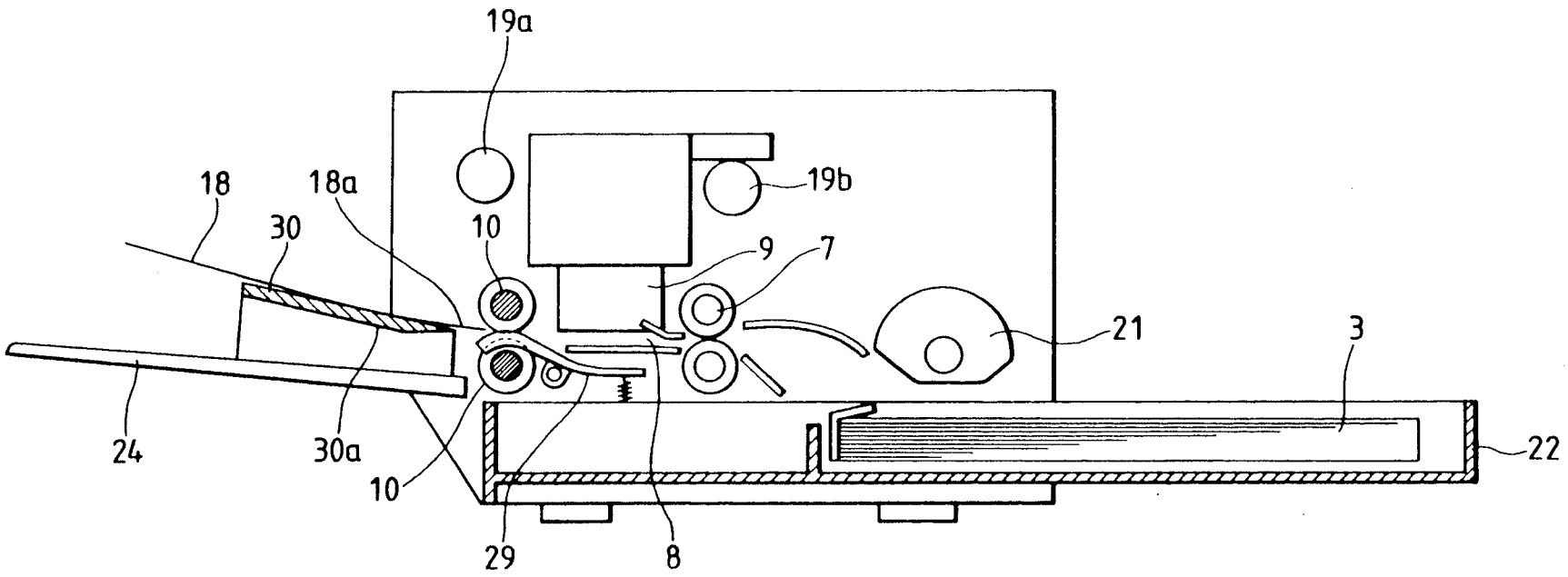
FIGS. 6, 7 and 8 are schematic sectional elevational views of recording apparatuses according to other embodiments of the present invention.

In the illustrated embodiment, while the apparatus was made small-sized by using the ejector tray 24 also as the manual sheet supply tray by making the manual sheet supply guide plate 24*a* pivotable with respect to the ejector tray 24. As shown in FIG. 6, a manual sheet supply tray 30 may previously have been fixed on the ejector tray 24. In this case, the same technical effects as those obtained by the illustrated embodiment can be obtained. Also in this case, an end 30*a* of the manual sheet supply tray 30 is aligned with the nip between the rollers 10 and the manual sheet supply tray 30 is provided with a guide portion for directing the ejected sheet toward the ejector tray 24.

Figure 7:
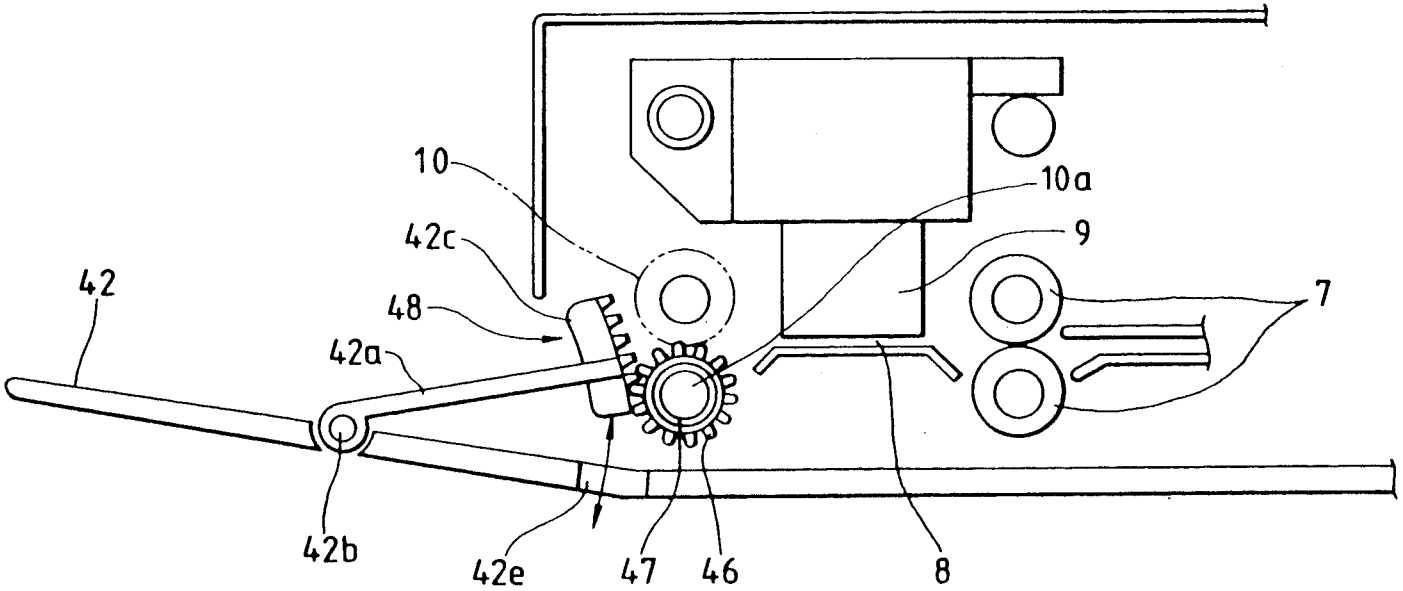

Further, in the illustrated embodiment, while the manual sheet supply guide plate 24*a* was shifted by the plunger 20, it may be shifted upwardly and downwardly by the reverse and normal rotations of the ejector rollers 10 through an appropriate gear train and clutch. An example of such alteration is shown in FIG. 7 wherein a manual sheet supply guide 42*a* is shown shifted upwardly to provide a manual sheet supply inlet 48. An arcuate gear portion 42*c* attached to the free end of the manual sheet supply guide 42*a* outside of a sheet feeding path and pivotable around a pivot 42*b* is meshed with a gear 46 attached, through an electromagnetic clutch, to a roller shaft 10*a* of one of the ejector rollers 10. The gear 46 can be rotated together with the ejector rollers 10 when the electromagnetic clutch 47 is energized. Incidentally, the reference numeral 42*c* denotes a through opening formed in an ejector tray 42 for passing the arcuate gear portion 42*c*.

With the arrangement mentioned above, when a sheet supply start button (not shown) is depressed for performing the sheet supply operation, the electromagnetic clutch 47 is energized, and the lower ejector roller is rotated in a clockwise direction (FIG. 7) together with the gear 46 to shift the arcuate gear portion 42*c* upwardly, thereby lifting the manual sheet supply guide 42*a* in the position shown in FIG. 7. After the manual sheet supply guide has reached the position shown in FIG. 7 (the position is determined by the timer up or by the detection by means of a position detecting means), the rotation of the ejector rollers 10 is stopped to maintain the manual sheet supply guide 42*a* in the position shown in FIG. 7. Unless the electromagnetic clutch 47 is deenergized, the manual sheet supply guide 42*a* is held in the reached position due to friction forces in a driving system for the ejector rollers and the like.

Thereafter, the sheet is manually inserted into the sheet supply inlet 48 and at the same time the electromagnetic clutch 47 is deenergized, and the ejector rollers 10 are rotated in the clockwise direction (the reverse direction) again. In this way, the manually inserted sheet is introduced into the apparatus in the same manner as previously explained.

Upon ejection of the sheet, since the ejector rollers 10 are rotated in an anti-clockwise direction (the normal direction), when the electromagnetic clutch 47 is again energized for a predetermined time period, the gear 46 is also rotated in the anti-clockwise direction to lower the manual sheet supply guide 42*a*, thus providing the ejection outlet, similar to the previous embodiment. After the manual sheet supply guide 42*a* has completely been lowered, the electromagnetic clutch 47 is deenergized so that the sheet can be ejected on the ejector tray 42 without trouble.

Further, in the illustrated embodiment, while the recording apparatus which prints the image on the sheet by injecting the liquid (ink) droplets was explained, it should be noted that any printing system may be used. Further, while, as the first sheet supply means, the sheet supply from the cassette was described, the first sheet supply means may be constituted by other appropriate devices, and three or more sheet supply means may be adopted.

Figure 8:
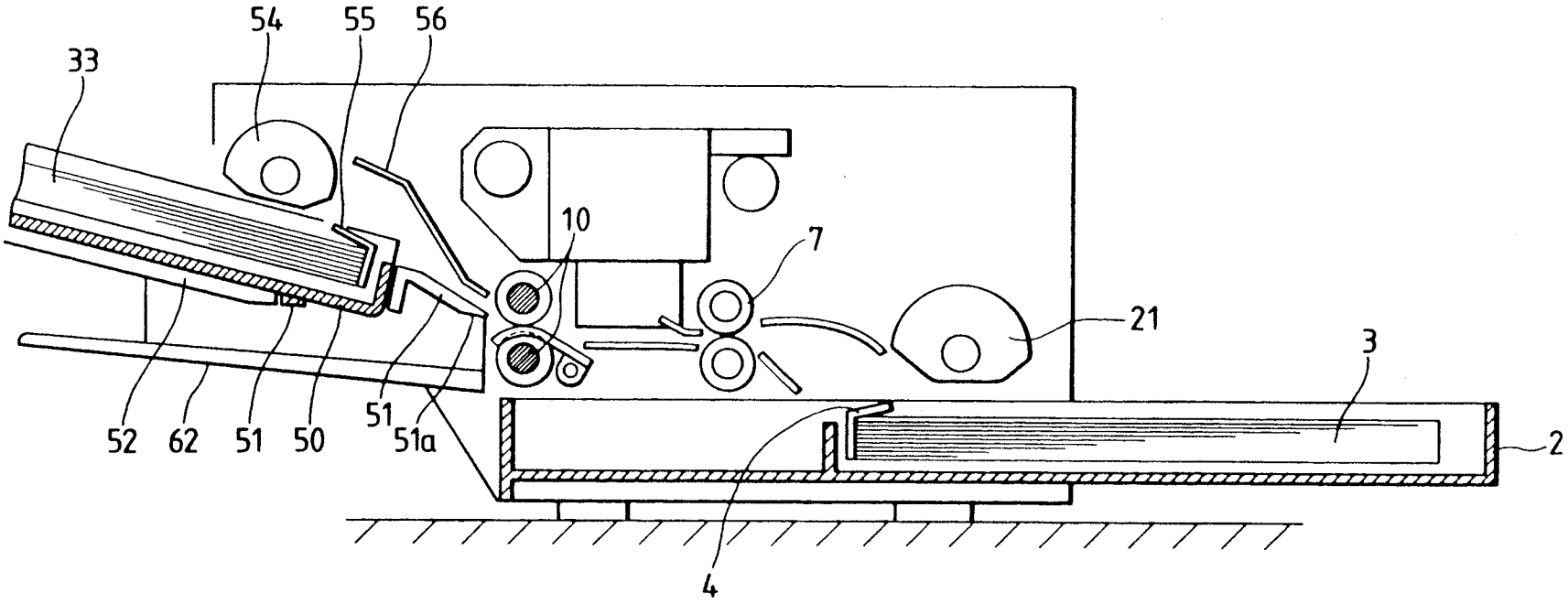

Furthermore, in the illustrated embodiment, while, as the second sheet supply means, the manual sheet supply system wherein the sheet is manually inserted one by one was described, the second sheet supply means may be constituted by an additional cassette from which the sheet can be fed one by one as shown in FIG. 8, or may be constituted by multimanual sheet supply. In FIG. 8, an additional sheet supply cassette 50 is supported on the recording apparatus by a sheet supply guide member 51 and a cassette support member 52, and is held in plate on the cassette support member 52 by a holder 51*b*. An uppermost sheet in a sheet stack 33 accommodated in the cassette is separated from the sheet stack by means of a sheet supply roller 54 and a separating claw 55, and is guided toward the ejector rollers 10 by a guide plate 56. In this case, as explained in the previous or first embodiment, the sheet can be introduced into the apparatus by rotating the ejector rollers 10 in the reverse direction.

After the sheet has been subjected to the printing operation in the same manner as described with respect to the first embodiment, the sheet is ejected toward an ejector tray 62 by an inclined guide portion 51*a* of the sheet supply guide member 51.

Figure 12:
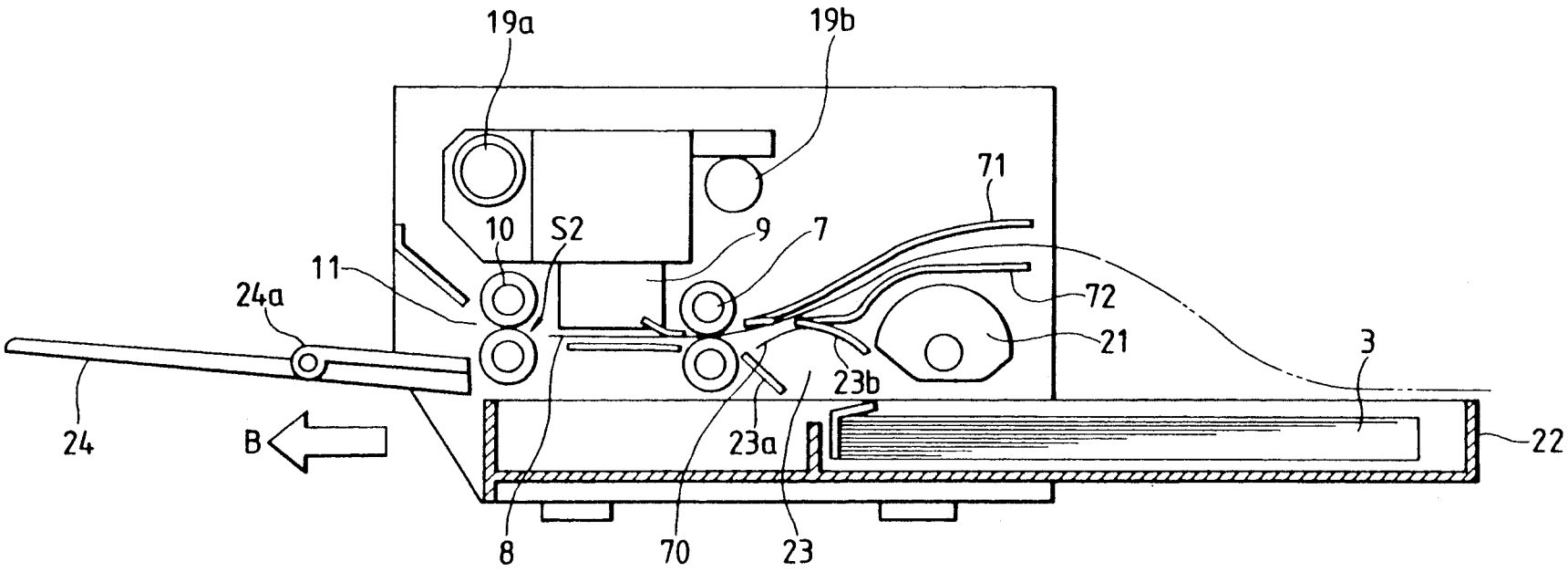
FIG. 12 is a schematic sectional elevational view of a recording apparatus according to a further embodiment of the present invention.

As shown in FIG. 12, an elastic Mylar film 70 may be arranged in the sheet feeding path between the sheet supply roller 21 and the auxiliary scanning rollers 7 so that the sheet fed from the left can be directed to an exclusive sheet path (constituted by guides 71 and 72). Further, when the sheet is inserted from the left (FIG. 12), at the time when the trailing end of the sheet is detected by a sensor $S_2$, the rollers 10, 7 may be stopped, and, thereafter, the rollers 10, 7 may be rotated reversely in the normal direction to feed the sheet leftwardly and at the same time the printing operation may be started.

According to the illustrated embodiments, by utilizing the ejection outlet for the sheet fed from the first supply means as the sheet supply inlet for the sheet from the second sheet supply means, the first sheet supply means (the sheet supply from the cassette), second sheet supply means (manual sheet supply), and ejector tray and the like can all be arranged at one side (front side) of the recording apparatus. Accordingly, since all of the operations can be performed at the same side (front side) of the recording apparatus, the recording apparatus can be used a manner so that the apparatus may be installed on a shelf or the like, thus saving installation space.

Further, since there is no need to provide an exclusive sheet supply roller and sheet feeding rollers as additional sheet feeding means for the manual sheet supply and the number of the guide plates can be minimized and the ejector tray can also be used as the manual sheet supply tray, the whole recording apparatus can be made small-sized and inexpensive.

Next, means for positively preventing the floating of the recording sheet without exerting a bad influence upon the feeding of the sheet will be fully explained.

Figure 13:
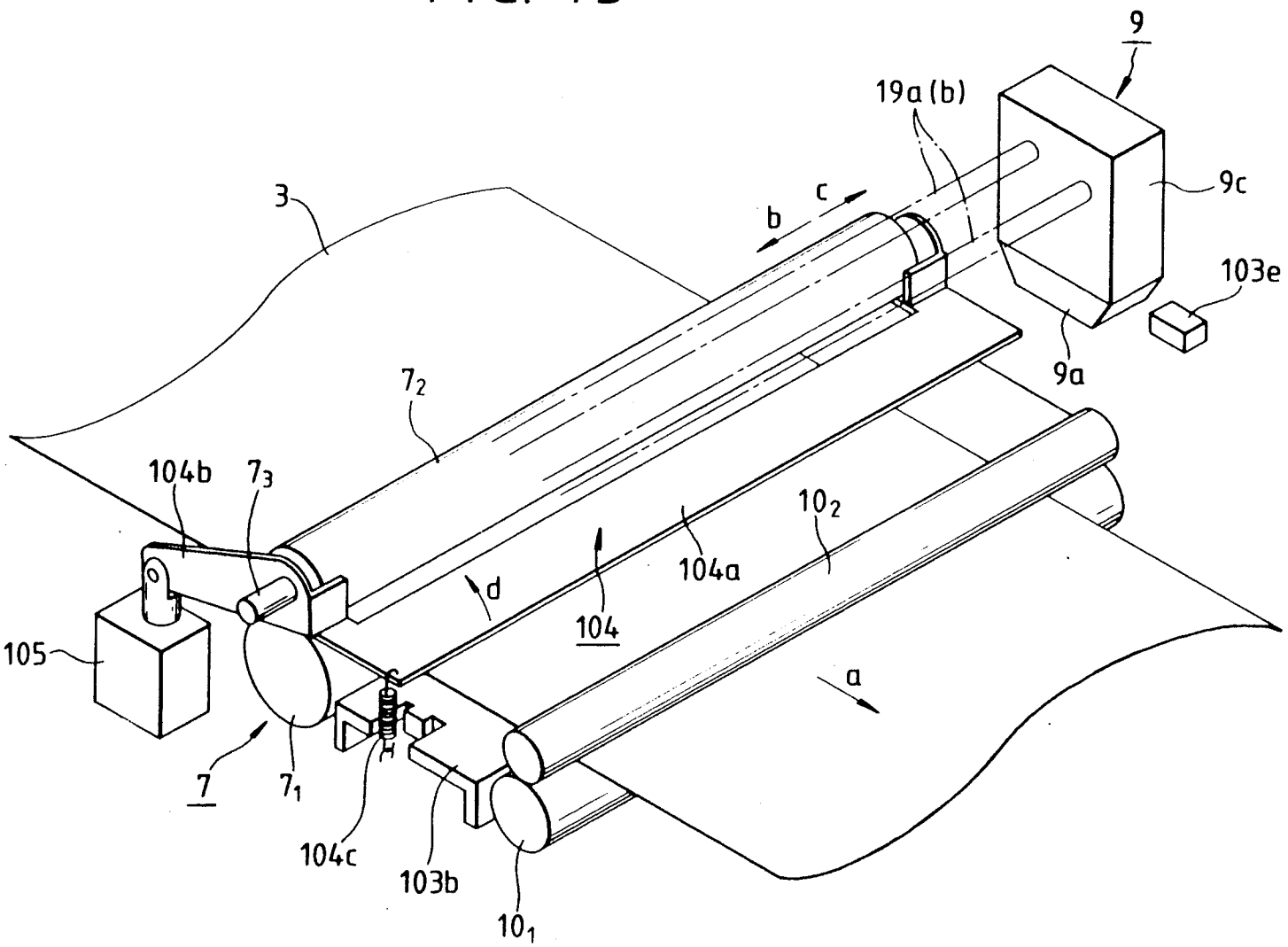
FIG. 13 is a perspective view showing the details of means for preventing floating of a sheet.

FIG. 13 is a perspective view of a recording apparatus including means for preventing the floating of the sheet.

The recording apparatus is so constructed that it can feed the sheet (recording sheet) supplied from the sheet supply means by the sheet feeding means (auxiliary scanning rollers) 7 and can record a predetermined image on the sheet by the recording means (printing head) 9, and is also so constructed such that the recording sheet 3 is held down by a sheet hold-down member 104 during the recording operation.

The sheet feeding means 7 comprises a first pair of conveying rollers $7_1$, $7_2$ and a second pair of conveying rollers (ejector rollers) $10_1$, $10_2$. The first and second conveying rollers $7_1$ and $10_1$ are rotated by a conveying motor (not shown) to feed the recording sheet 3 to the direction a.

Incidentally, the second conveying rollers $10_1$, $10_2$ receive a rotational force, respectively, from the motor through a sliding clutch (not shown) to apply a proper tension to the recording sheet 3 to be fed.

The recording means 9 comprises an ink jet recording head 9*a* and a platen 103*b* arranged in confronting relation to the recording head. The recording head 9*a* is mounted on a carriage 9*c*. The carriage 9*c* can be shifted reciprocably in the direction b or c along guide shafts 19*a*, 19*b* by means of a carriage motor and drive transmission system (not shown). During the movement of the carriage, a predetermined image is recorded on the recording sheet by injecting the ink droplets from the recording head 9*a* in response to an image signal. Incidentally, a home position sensor 103*e* for detecting a home position of the carriage 9*c* is arranged in the home position of the carriage.

Further, the sheet hold-down member 104 comprises a plate-shaped hold-down portion 104*a* and arm portions 104*b* formed on both ends of the hold-down portion. The arm portions are rotatably mounted on a roller shaft $7_3$ of the first conveying roller $7_2$. By a tension spring 104*c* connected to the hold-down portion 104*a*, the latter can urge the recording sheet 3 against the platen 103*b*.

The sheet hold-down member 104 can be abutted against and separated from the recording sheet 3 by urging/retracting means which, in the illustrated embodiment, is constituted by a solenoid 105. More particularly, the solenoid 105 is attached to an end of the arm portion 104*b*, and, when the solenoid 105 is turned ON, the arm portion 104*b* is rotated in the direction shown by the arrow d, thus separating the hold-down portion 104*a* from the recording sheet 3. On the other hand, when the solenoid 105 is turned OFF, the hold-down portion 104*a* is pulled by the spring 104*c* to urge the recording sheet 3 against the platen 103*b*. The hold-down member is downwardly inclined rightwardly.

Figure 14:
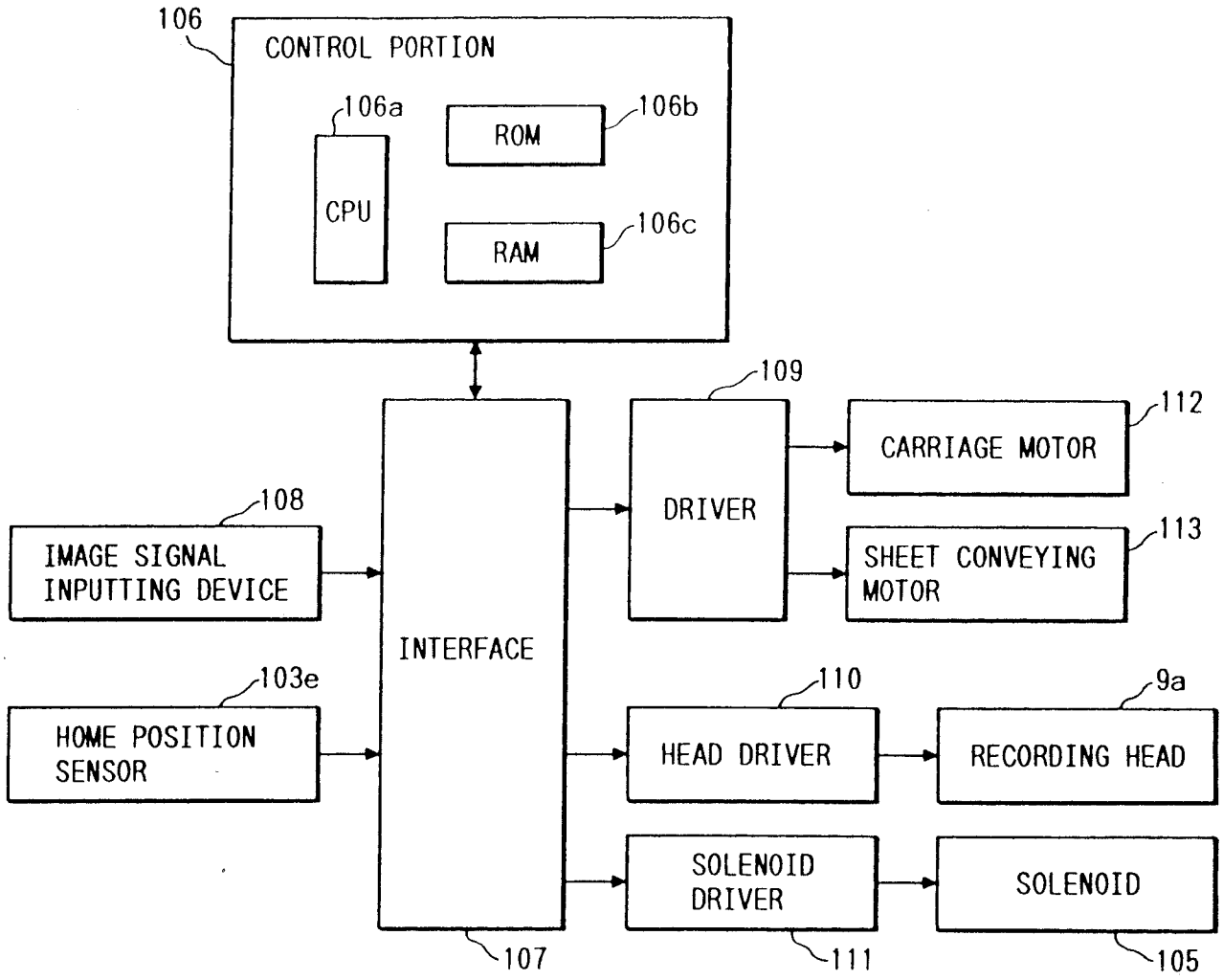
FIG. 14 is a control block diagram for the means of FIG. 13.

The sheet hold-down member 104 is turned ON and OFF in response to the feeding and recording of the recording sheet 3, respectively, by a control system shown in FIG. 14.

More particularly, an image signal inputting device 108 and the home position sensor 103*e* are connected, through an interface 107, to a control portion 106 including a CPU 106*a* such as a microprocessor, a ROM 106*b* storing a control program for the CPU 106*a* and various data, and a RAM 106*c* being used as a work area for the CPU 106*a* and temporarily storing various data. The control portion receives the image signal from the image signal inputting device 108 and a detection signal (representing whether the carriage 9*c* is in the home position) from the home position sensor 103*e*.

Further, a motor driver 109, a head driver 110 and a solenoid driver 111 are connected to the control portion 105 through the interface 107. By a signal from the control portion 106, the motor driver 109 drives a carriage motor 112 for shifting the carriage 9*c* and a sheet conveying motor 113 for rotating the conveying rollers $7_1$ and $10_1$. The solenoid driver 111 drives the solenoid 105.

Figure 15:
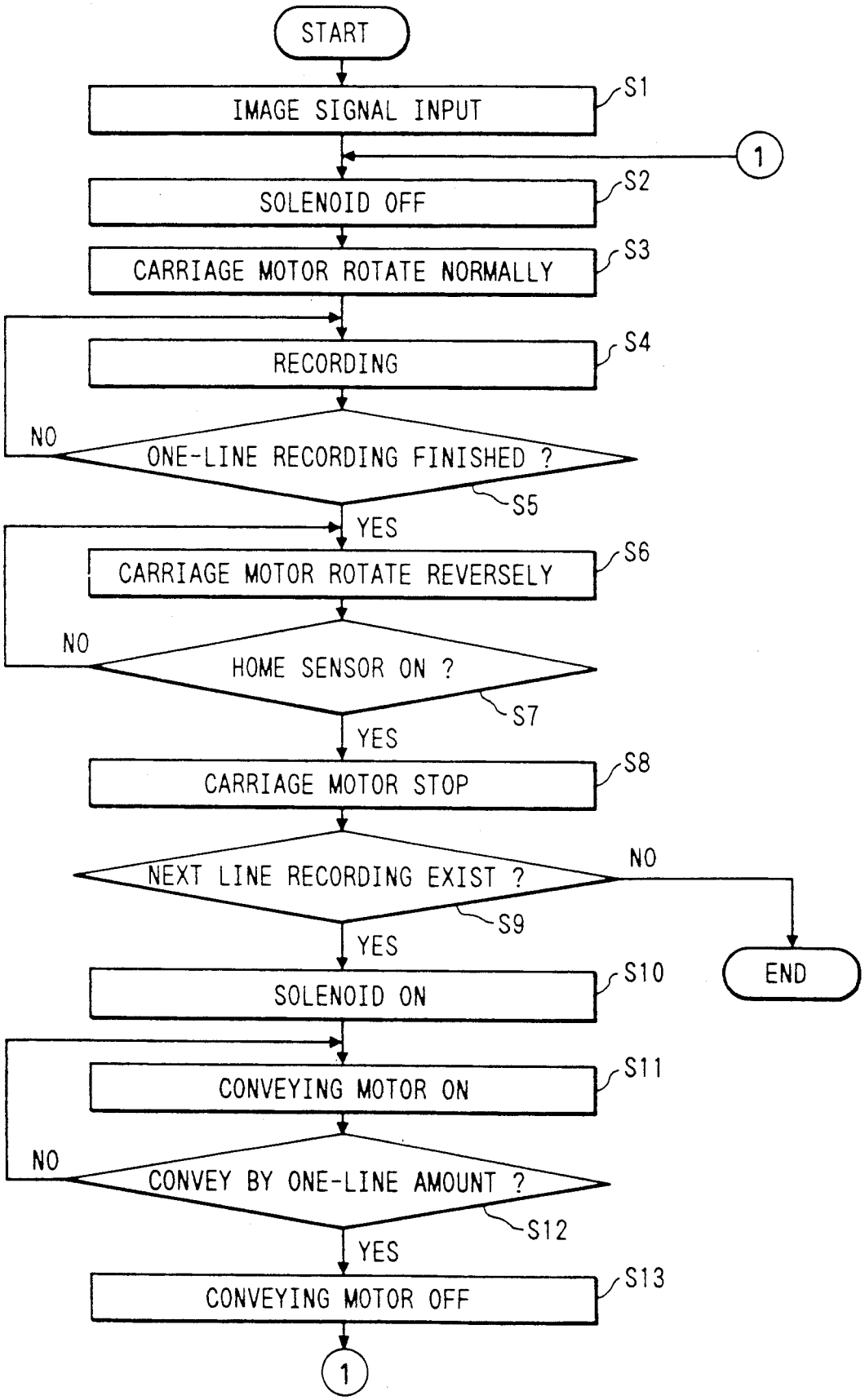
FIG. 15 is a flow chart showing the recording sequence.

Next, an operating sequence for the sheet hold-down member 104 and the like performed when the recording operation is carried out by the recording apparatus constructed as mentioned above will be explained with reference to a flow chart shown in FIG. 15.

First of all, when the control portion 106 receives an image signal from the image signal inputting device 108, the solenoid 105 is turned OFF (S1, S2), whereby the sheet hold-down member 104 urges the recording sheet 3 against the platen through the bias force of the tension spring 104*c*. Then, the carriage motor 112 is rotated normally to shift the carriage 9*c* in the direction shown by the arrow b, and the printing or recording head 9*a* injects the ink to record the image on the recording sheet 3 in response to the image signal (S3, S4).

When the one-line recording is finished (S5), the carriage motor 112 is rotated reversely to shift the carriage 9*c* in the direction shown by the arrow c (S6), and, when the carriage 9*c* is returned to the home position, the carriage motor 112 is stopped (S8).

Then, if a next line recording does not exist, the recording operation will be finished. On the other hand, if a next line recording exists, the solenoid 105 is turned ON (S9), whereby the sheet hold-down member 104 turns toward the direction shown by the arrow d to separate from the recording sheet 3 (S10). In this condition, the conveying motor 113 is rotated by a predetermined amount to convey the recording sheet 3 in the direction shown by the arrow a (FIG. 13) by one-line amount (S11–S12) and then the conveying motor is turned OFF (S13). Then, the sequence is returned to the step S2 and the same procedures are repeated.

As mentioned above, during the recording operation, by pressing the recording sheet 3 against the platen 103*b* by means of the sheet hold-down member 104, the slack and/or the floating of the recording sheet 3 are prevented to record the image with high quality; whereas, during the feeding of the sheet, by separating the sheet hold-down member 104 from the recording sheet 3, the load required for conveying the sheet is reduced to increase the conveying accuracy.

Figure 16:
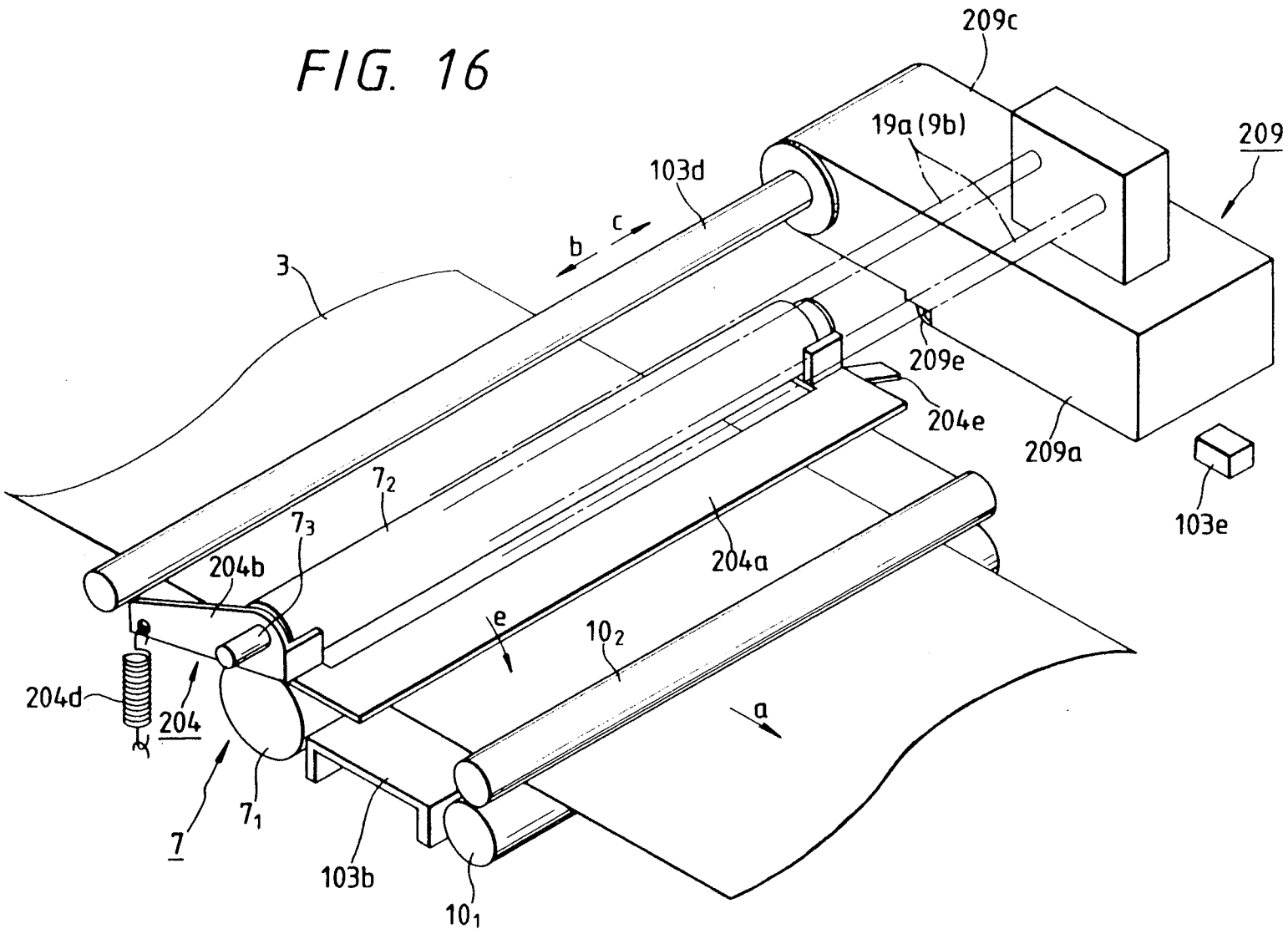
FIGS. 16 and 18 are a perspective view and a cross-sectional view, respectively, showing another example of means for preventing floating of a sheet.

In the illustrated embodiment mentioned above, while the sheet hold-down member 104 was shifted by the solenoid 105, as another embodiment as shown in FIG. 16, the sheet hold-down member 204 may be shifted by scanning the carriage 209*c*. Incidentally, in this another embodiment, the same constructural elements as those shown in the previous embodiment are designated by the same reference numerals as those used in the previous embodiment, and the detailed explanation thereof will be omitted.

In FIG. 16, a tension spring 204*d* attached to an end of an arm portion 204*b* of the sheet hold-down member 204 urges to separation of a hold-down portion 204*a* from the recording sheet 3. A gently sloped surface portion 204*e* is arranged at an end (near the home position of the carriage 209*c*) of the hold-down portion 204*a*, and a rotatable roller 209*e* is arranged on an lower surface of the carriage 209*c*.

Figure 17:
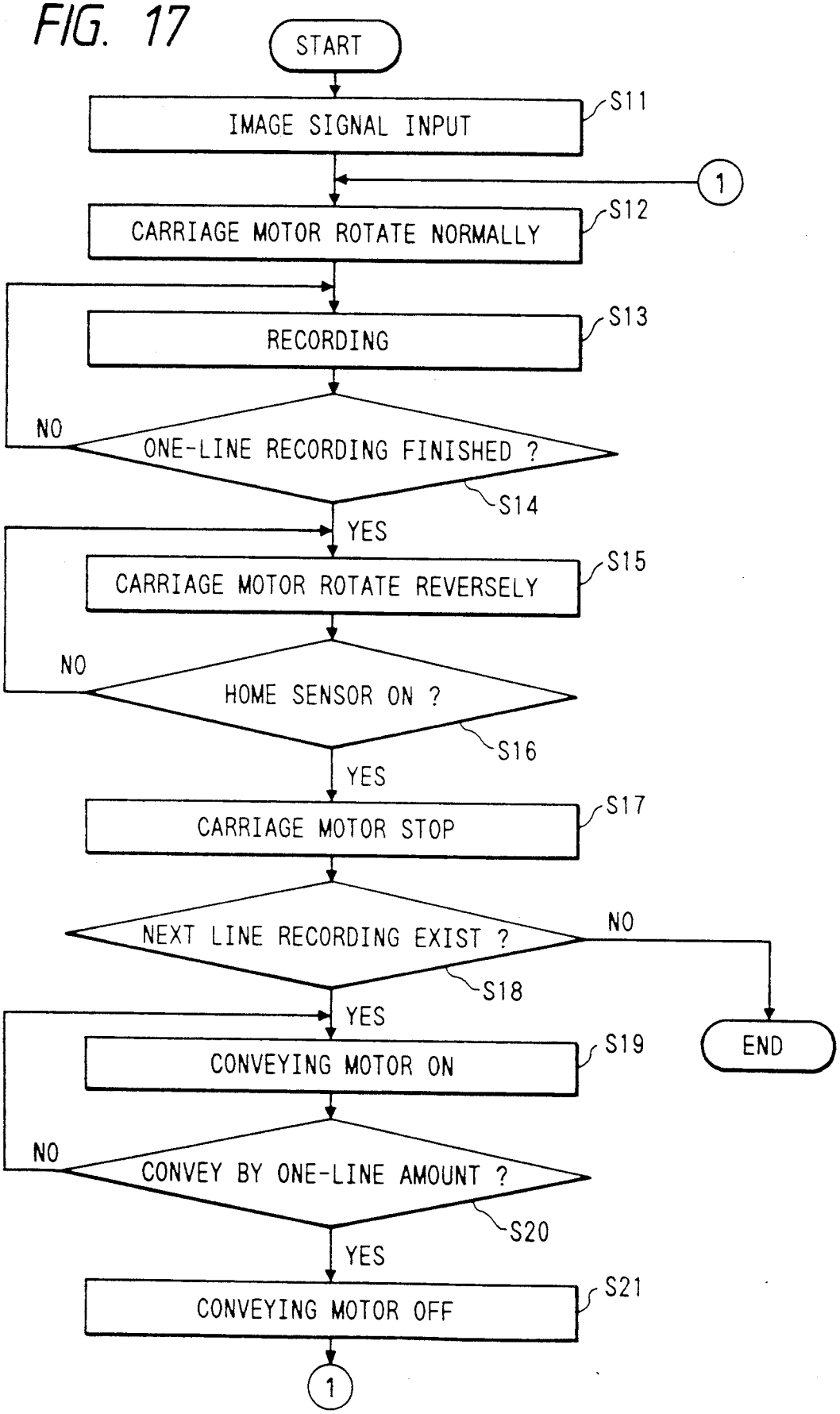
FIG. 17 is a flow chart showing the recording sequence of a apparatus including the means for preventing the sheet floating of FIGS. 16 and 18.
Figure 18:
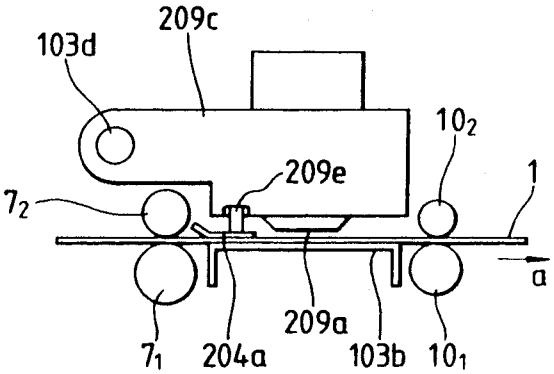

With this arrangement, when the carriage 209*c* is shifted in accordance with the recording sequence (S11–S12) shown in a flow chart of FIG. 17, the sheet hold-down member 204 will be urged against or separated from the recording sheet 3. That is to say, when the carriage 209*c* is in the home position, the hold-down portion 204*a* of the sheet hold-down member is separated from the recording sheet 3 by the bias force of the spring 204*d*; whereas, during the recording operation, when the carriage 209*c* is shifted in the direction shown by the arrow b, the roller 209*e* rides on the sloped surface portion 204*e* to turn the sheet hold-down member 204 in the direction shown by the arrow e, whereby the carriage is shifted while pressing the hold-down portion 204*a* against the recording sheet 3 as shown in FIG. 18. When the carriage 209*c* is returned to the home position to separate the roller 209*e* from the sloped surface portion 204*e*, the hold-down portion 204*a* is again separated from the recording sheet 3.

Accordingly, in this embodiment, the recording sheet 3 can be pressed against the platen 103*b* positively during the recording operation and the sheet hold-down member can be separated from the recording sheet 3 during the shifting of the sheet, without using any shifting means such as a solenoid, whereby a portion of the recording sheet facing to the recording head 209*a* is positively held down against the platen 103*b*.

In the illustrated embodiments, while rollers were used as the feeding means, the feeding means is not limited to rollers, but may be constituted by any means capable of feeding the recording sheet, and accordingly, may be constituted by, for example, rotating belts.

Next, manipulations for the manual sheet supply and the sheet supply from the cassette will be fully explained.

a. During Sheet Supply from Cassette

Figure 19:
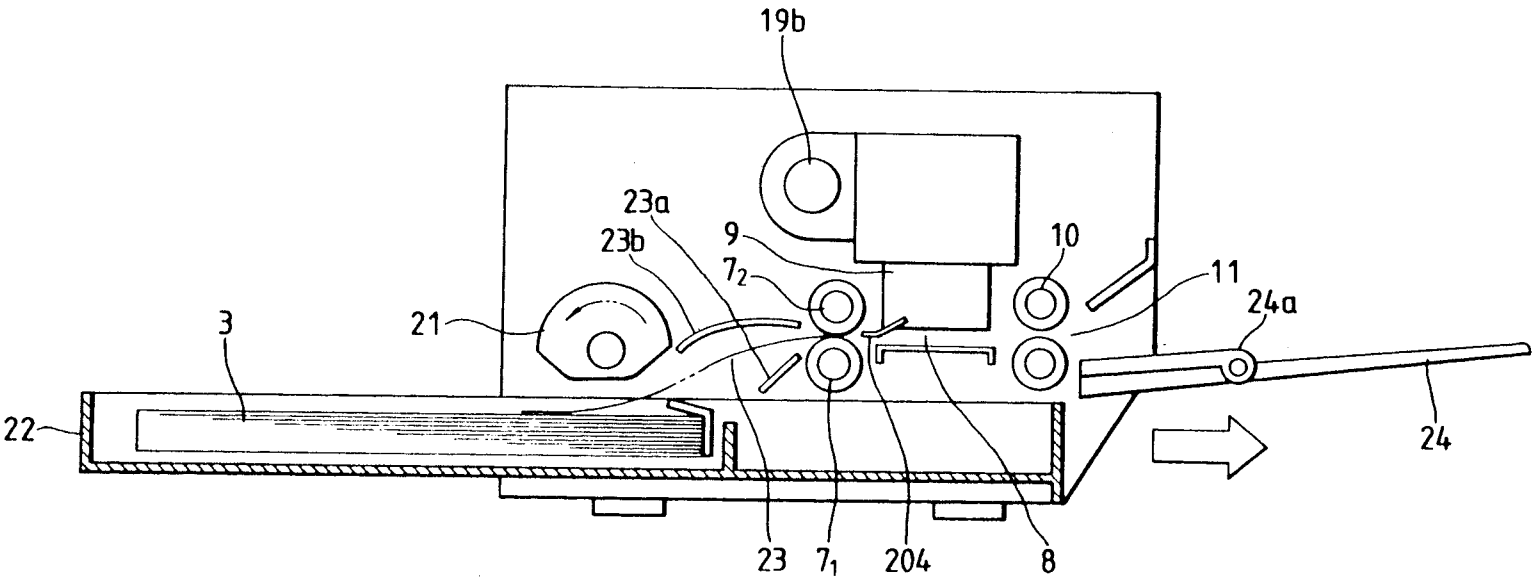
FIG. 19 is a schematic sectional elevational view of the apparatus of FIG. 2 viewed from the back side thereof, for explaining the sheet supply from the cassette.

In FIG. 19, the sheet 3 supplied from the cassette 22 is stopped by abutting against the regist roller $7_2$. Thereafter, in response to the print command, the sheet is fed to the printing position by means of the first conveying (regist) rollers 7. In this case, the carriage 209*c* is waiting in the home position situated outside of the sheet feeding path as shown in FIG. 16, and the sheet hold-down member 204 is retracted from the sheet by means of the spring 204*d* When a predetermined number of pulses are counted (i.e., when the leading end of the sheet reaches the printing position) after the regist rollers 7 have been started to rotate, the carriage 209*c* scans the sheet along the rail 103*d* to perform the one-line recording; meanwhile, when the roller 209*e* rides on the sheet hold-down member 204, the latter is pressed against the sheet.

FIG. 18 is a sectional view showing such condition, which provides the following advantages: (i) The sheet hold-down member can prevent the floating of the sheet up to the vicinity of the printing position; (ii) Even if a thickness of the sheet is changed, since there is the roller (209*e*), the distance between the printing head and the sheet can remain unchanged; (iii) Even if the roller is smeared by the ink, since the roller does not contact the sheet directly, the sheet is not smeared by the ink; and (iv) Since the feeding of the sheet for the next line recording is carried out after the carriage has been returned to the home position and the sheet hold-down member has been retained from the sheet, an excessive load is not applied to the sheet, thereby maintaining the high accuracy of sheet feeding.

When recording through the whole area of the sheet is finished by repeating a predetermined number of printing operations and sheet feeding operations, the sheet is ejected on the ejector tray where the manual sheet supply guide plate is lowered.

Incidentally, in the above embodiment (FIG. 19), the sheet may be fed to the second conveying rollers (ejector rollers) 10 in response to the print command. In this case, thereafter, the recording is started by actuating the printing head. The recording is started when a predetermined number of pulses are counted (i.e., when the sheet reaches the rollers 10) after the regist rollers 7 has been started to rotate.

b. During Manual Sheet Supply

Figure 20:
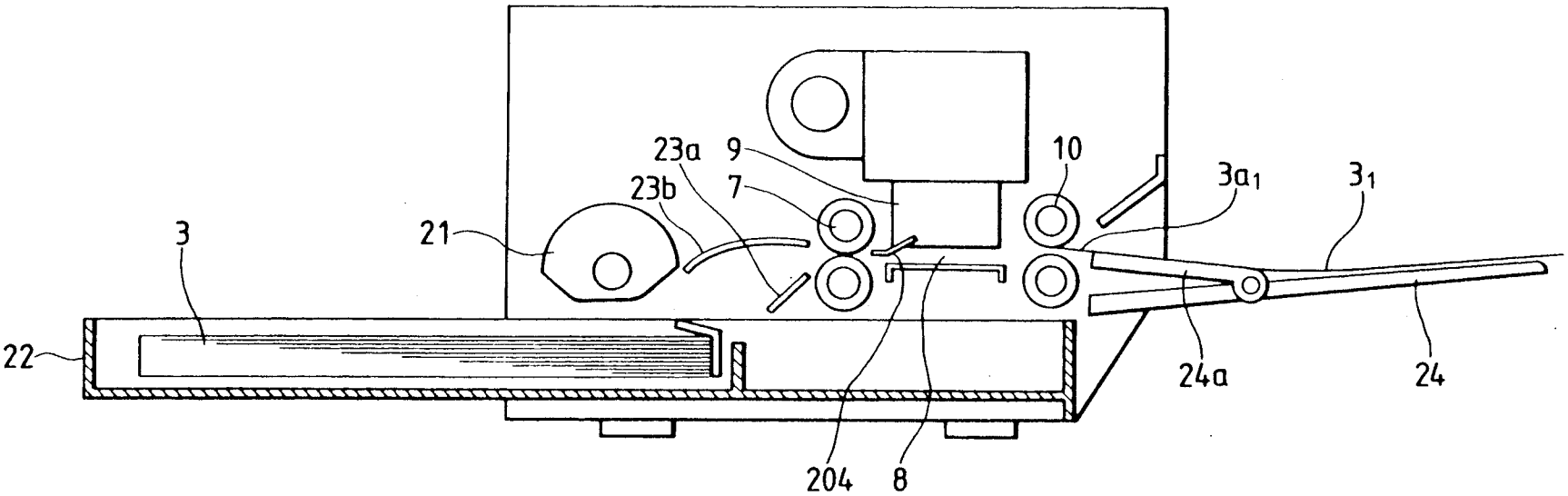
FIGS. 20 to 22 are a schematic sectional elevational views of the recording apparatus of FIG. 3 viewed from the back side thereof, for explaining the manual sheet supply.

In FIG. 20, when the manual sheet supply button (not shown) is depressed, the manual sheet supply guide 24*a* on the tray 24 is turned upwardly to reach the position shown in FIG. 20. When the sheet is inserted along the manual sheet supply guide, the conveying rollers 10 are rotated reversely to introduce the sheet $3_1$ toward the interior of the apparatus.

Figure 21:
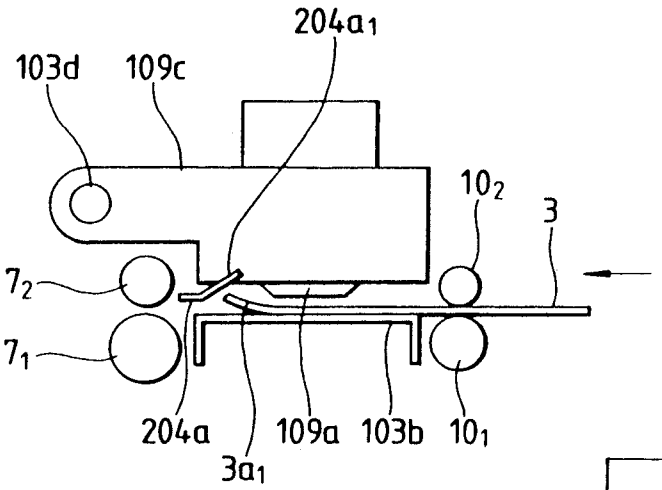

FIG. 21 is a sectional view showing the vicinity of the platen, where the sheet hold-down member 204 is held in the retarded position where the sheet hold-down member is separated from the sheet, since the carriage is stopped in the home position during the normal rotation of the conveying rollers 10. In this embodiment, since the sheet hold-down member 204 is mounted for pivotal movement around the roller shaft $7_3$ of the first conveying roller, in this condition, the free end $204a_1$ of the sheet hold-down member is held in a raised or lifted position. Thereby, even if the leading end $3a_1$ of the sheet is curled, the leading end of the sheet can be guided by the sheet hold-down member 204 to be fed to the nip between the first conveying rollers effectively.

Figure 22:
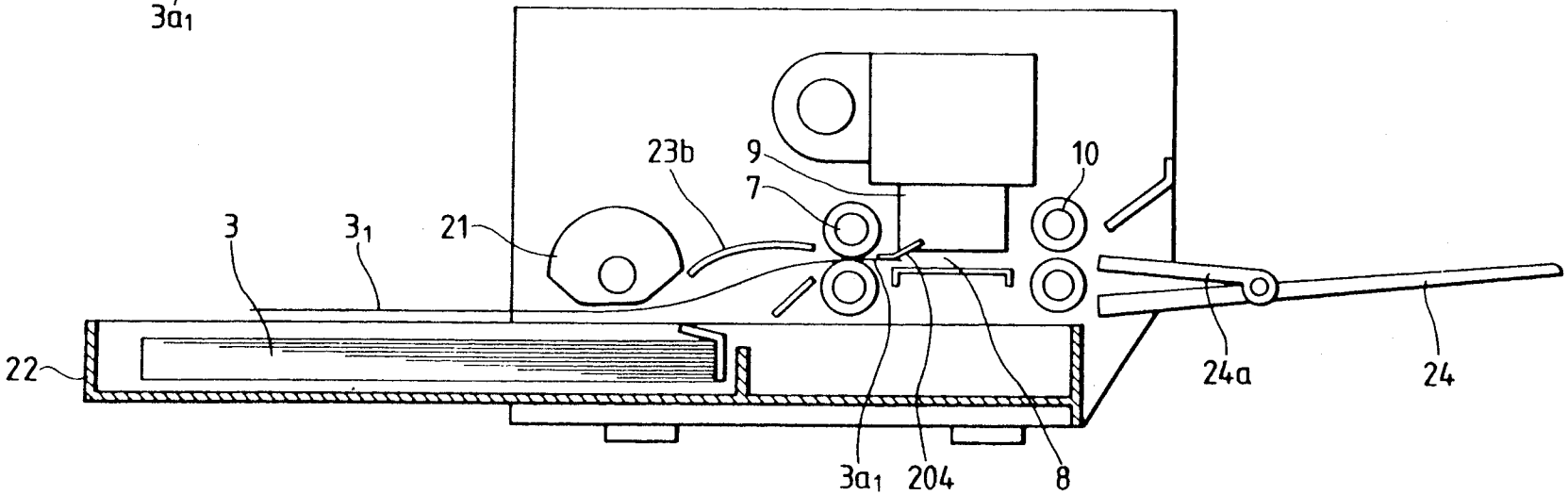

After the sheet is further fed to reach a predetermined position as shown in FIG. 22, the conveying rollers 7 are rotated normally to feed the sheet by a predetermined amount. Whenever the sheet is fed b the predetermined amount, the carriage is reciprocably shifted (and the sheet hold-down member 204 is lowered downwardly by the carriage roller to hold-down the sheet) to perform the printing operation in the same manner as mentioned above.

Further, the manual sheet supply guide 24*a* is returned to the lowered position by the plunger 20 through the normal rotation of the rollers 7, 10 (in response to the print start signal), and accordingly, the printed sheet is ejected onto the tray 24, as similar to the case of the sheet supply from the cassette.

According to the embodiments (FIGS. 2–22) of the present invention, by utilizing the ejection outlet for the sheet fed from the first sheet supply means as the sheet supply inlet for the sheet from the second sheet supply means, the first sheet supply means (the sheet supply from the cassette), second sheet supply means (manual sheet supply), and ejector tray and the like can all be arranged at one side (front side) of the recording apparatus. Accordingly, since all of the operations can be performed at the same side (front side) of the recording apparatus, the recording apparatus can be used in a manner such that the apparatus may be installed on the shelf or the like, thus saving the installation space.

Further, since there is no need for providing the exclusive sheet supply roller and sheet feeding rollers as additional sheet feeding means for the manual sheet supply and the number of the guide plates can be minimized and the ejector tray can also be used as the manual sheet supply tray, the whole recording apparatus can be made small-sized and inexpensive.

What is claimed is:

1. A recording apparatus, comprising:

supply means for supplying sheets;

a sheet directing path for directing the sheets supplied by said supply means to a recording portion;

a sheet ejection path for directing the sheets recorded on at said recording portion to an ejection outlet; and sheet feeding means for directing a sheet supplied from outside of said recording apparatus through said ejection outlet to said recording portion in a first direction and thereafter for returning the recorded sheet to said ejection outlet by shifting its direction of conveyance to a direction reverse to the first direction.

2. A recording apparatus according to claim 1, wherein said sheet directing path and said sheet ejection path are substantially straight.

3. A recording apparatus according to claim 1, wherein said ejection outlet is provided with ejecting and introducing rollers, and wherein switch means having sheet detecting portions are arranged on both upstream and downstream sides of said rollers.

4. A recording apparatus according to claim 3, wherein each of said sheet detection portions comprises a lever portion and is urged by the sheet to be ejected and by the sheet to be introduced.

5. A recording apparatus according to claim 4, further including means for counting a predetermined time period after said switch means have been controlled.

6. A recording apparatus according to claim 1, wherein said supply means is provided with a cassette means for insertion from a side of said ejection outlet and a feeding means for feeding the sheet from a trailing end side of said sheet material accommodating means.

7. A recording apparatus according to claim 6, wherein said sheet directing path, recording portion and sheet ejection path are arranged at a level substantially horizontally to one another, and said cassette means is horizontally below said level and inserted into or removed from said apparatus.

8. A recording apparatus according to claim 6, wherein the sheets supplied through said ejection outlet pass through said sheet directing path and partially into said cassette means.

9. A recording apparatus according to claim 8, wherein said feeding means is comprised of a semi-circular cut roller the flat portion of which is oriented downwardly when the sheets are not being fed so as to interrupt contact between said roller and the sheet.

10. A recording apparatus according to claim 6, further comprising a path for introducing a sheet supplied from said ejection outlet out of said cassette means after passing through said recording portion.

11. A recording apparatus according to claim 1, wherein said sheet feeding means is provided with a cassette means removable relative to said ejection outlet.

12. A recording apparatus according to claim 1, further comprising a control means for controlling a sheet supplied from outside of said recording apparatus so that the sheet is recorded at said recording portion when shifted in the direction reverse to the first direction.

13. A recording apparatus according to claim 1, further comprising a sheet detecting means, provided at said ejection outlet, for detecting presence of the sheet supplied to said ejection outlet passed through said sheet ejection path, and for detecting presence of the sheet supplied to said ejection outlet from outside of said recording apparatus.

14. A recording apparatus according to claim 1, wherein a recording means is provided at said recording portion and said recording means performs a recording operation by creating a conditional change including formation of bubbles in liquid by use of thermal energy to create a liquid droplet.

15. A recording apparatus comprising:

supply means for supplying sheets;

a sheet directing path for directing the sheets supplied by said supply means to a recording portion;

a sheet ejection path for directing the sheets recorded on at said recording portion to an ejection outlet;

guide means for guiding a sheet to be introduced from said ejection outlet; and sheet feeding means for directing the introduced sheet to said recording portion through said sheet ejection path and thereafter for returning the sheet to said ejection outlet, wherein said guide means also serve as a sheet ejector tray, and includes a guide plate pivotable upwardly and downwardly.

16. A recording apparatus according to claim 15, wherein said guide plate has an end and is pivotable upwardly and downwardly in such a manner that said end is aligned with said ejection outlet during the introduction of the sheet and that said end is retracted from said ejection outlet during the ejection of the sheet.

17. A recording apparatus according to claim 16, further comprising a drive means for controlling a pivotal movement of said guide plate.

18. A recording apparatus according to claim 16, further comprising a rotary member provided at said ejection outlet for feeding a sheet, wherein the pivotal movement of said guide plate is controlled in response to a rotation of said rotary member.

19. A recording apparatus, comprising:

supply means for supplying sheets;

a sheet directing path for directing the sheets supplied by said supply means to a recording portion;

a sheet ejection path for directing the sheets recorded at said recording portion to an ejection outlet;

sheet feeding means for directing a sheet supplied from outside of said recording apparatus through said ejection outlet to said recording portion in a first direction and thereafter returning the recorded sheet to said ejection outlet by shifting its direction of conveyance to a direction reverse to the first direction;

recording means provided at said recording portion for recording an image by serially scanning the sheet fed; and sheet hold-down member for abutting against and separating from the sheet in response to the movement of said recording means.

20. A recording apparatus according to claim 19, further including means for separating said sheet hold-down member from the sheet when said recording means is in a waiting position.

21. A recording apparatus according to claim 20, wherein said means for separating the sheet hold-down member from the sheet comprise a spring member and wherein said sheet hold-down member has a portion urged when the scanning operation of said recording means is carried out.

22. A recording apparatus according to claim 19, wherein said recording means performs a recording operation by creating the change in condition including the formation of bubbles in liquid by the use of thermal energy to create liquid droplet.

23. A recording apparatus, comprising:

supply means for supplying sheets;

a sheet directing path for directing the sheets supplied by said supply means to a recording portion;

a sheet ejection path for directing the sheets recorded at said recording portion to an ejection outlet;

sheet feeding means for directing a sheet supplied from outside of said recording apparatus through said ejection outlet to said recording portion in a first direction and thereafter returning the recorded sheet to said ejection outlet by shifting its direction of conveyance to a direction reverse to the first direction; and a sheet hold-down member which is separated from the sheet when the sheet is introduced from said ejection outlet and which is pressed against the sheet when the sheet is recorded.

24. A recording apparatus, comprising:

a supply means for supplying sheets;

a sheet directing path for directing the sheets supplied by said supply means to a recording portion; and a sheet ejection path for directing the sheets recorded at said recording portion to an ejection outlet, wherein said supply means is provided with a cassette means for insertion from a side of said apparatus on which said ejection outlet is located and a feeding means for feeding the sheet from a trailing end side of said cassette means, said sheet directing path, recording portion and sheet ejection path are arranged substantially horizontally, and said cassette means is inserted into or removed from horizontally below said sheet directing path, recording portion and sheet ejection path.

25. A recording apparatus according to claim 24, wherein said recording portion is an ink jet recording system.

26. A recording apparatus according to claim 25, wherein a recording means is provided at said recording portion and said recording means performs a recording operation by creating a conditional change including formation of bubbles in liquid by use of thermal energy to create a liquid droplet.

27. A recording apparatus, comprising:

guide means for guiding a sheet to be introduced from a feeding inlet/outlet; and sheet feeding means for feeding an introduced sheet to a recording portion through a sheet direction path and thereafter returning the sheet to said feeding inlet/outlet, wherein said guide means also serves as a sheet ejector tray and includes a guide plate pivotable upwardly and downwardly, said guide plate having an end and being pivotable upwardly and downwardly in such a manner that the end is aligned with said feeding inlet/outlet during the introduction of the sheet and that the end is retracted from feeding inlet/outlet during the ejection of the sheet.

28. A recording apparatus according to claim 27, further comprising drive means for controlling a pivotal movement of said guide plate.

29. A recording apparatus according to claim 27, further comprising a rotary member provided at said feeding inlet/outlet for feeding the sheet material, wherein the pivotal movement of said guide plate is controlled in response to a rotation of said rotary member.

* * * * *

UNITED STATES PATENT AND TRADEMARK OFFICE

CERTIFICATE OF CORRECTION

PATENT NO. : 5,177,547

DATED : January 5, 1993

INVENTOR(S) : SHINJI KANEMITSU, ET AL.

It is certified that error appears in the above-identified patent and that said Letters Patent is hereby corrected as shown below:

TITLE PAGE

IN RELATED U.S. APPLICATION DATA [63]

Line 1, "Continuation-in-part" should read --Continuation--.

COLUMN 1

Line 48, "afore-mentioned" should read --aforementioned--.

COLUMN 3

Line 17, "a" should be deleted.
Line 51, "thereby," should read --thereby--.
Line 52, "the" should be deleted.

COLUMN 4

Line 67, "deenergized," should read --deenergized and--.

COLUMN 5

Line 1, "FIG. 3; Meanwhile," should read --FIG. 3. Meanwhile,--.

COLUMN 6

Line 13, "timer up" should read --timer-up--.
Line 58, "plate" should read --place--

UNITED STATES PATENT AND TRADEMARK OFFICE

CERTIFICATE OF CORRECTION

PATENT NO. : 5,177,547 Page 2 of 2

DATED : January 5, 1993

INVENTOR(S) : SHINJI KANEMITSU, ET AL.

It is certified that error appears in the above-identified patent and that said Letters Patent is hereby corrected as shown below:

COLUMN 9

Line 34, "to" should be deleted.
Line 65, "to" should be deleted.

COLUMN 10

Line 64, "retarded" should read --retracted--.

COLUMN 11

Line 11, "b" should read --by--.

COLUMN 12

Line 10, "sheet material accommodating" should read --cassette--.

Signed and Sealed this

Fourth Day of January, 1994

Bruce Lehman

BRUCE LEHMAN

*Commissioner of Patents and Trademarks*

*Attest:*

*Attesting Officer*